US006846281B2

(12) United States Patent
Murayama et al.

(10) Patent No.: US 6,846,281 B2
(45) Date of Patent: Jan. 25, 2005

(54) BIO CELL CLEANING CENTRIFUGE HAVING DETACHABLE CHAMBER BODY

(75) Inventors: Kazuhiko Murayama, Hitachinaka (JP); Kenji Yamada, Hitachinaka (JP); Daijiro Shiraishi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 160 days.

(21) Appl. No.: 10/386,426

(22) Filed: Mar. 13, 2003

(65) Prior Publication Data

US 2003/0216237 A1 Nov. 20, 2003

(30) Foreign Application Priority Data

May 17, 2002 (JP) ..... P2002-142691

(51) Int. Cl.[7] ..... B04B 5/02; B04B 7/04; B04B 15/12

(52) U.S. Cl. ..... 494/17; 494/20; 494/29; 494/60

(58) Field of Search ..... 494/16–17, 20–21, 494/23, 27, 29–31, 33, 36, 60; 422/72

(56) References Cited

U.S. PATENT DOCUMENTS

| | | | | |
|---|---|---|---|---|
| 1,644,492 | A | * | 10/1927 | Rawolle |
| 2,834,541 | A | * | 5/1958 | Szent-Gyorgyi et al. |
| 3,175,732 | A | * | 3/1965 | Unger |
| 3,235,173 | A | * | 2/1966 | Unger |
| 3,352,486 | A | * | 11/1967 | Gibbs |
| 3,401,876 | A | * | 9/1968 | Lucas |
| 3,420,437 | A | * | 1/1969 | Blum et al. |
| 3,439,871 | A | * | 4/1969 | Unger |
| 3,606,142 | A | * | 9/1971 | Westberg |
| 3,684,161 | A | * | 8/1972 | Unger et al. |
| 3,712,535 | A | * | 1/1973 | Genese et al. |
| 3,722,789 | A | * | 3/1973 | Kennedy |
| 3,877,634 | A | * | 4/1975 | Rohde et al. |
| 3,951,334 | A | * | 4/1976 | Fleming et al. |
| 3,953,172 | A | * | 4/1976 | Shapiro et al. |
| 3,981,438 | A | * | 9/1976 | Weyant |
| 3,982,691 | A | * | 9/1976 | Schlutz |
| 4,190,530 | A | * | 2/1980 | Forsythe et al. |
| 4,285,463 | A | * | 8/1981 | Intengan |
| 4,431,423 | A | * | 2/1984 | Weyant, Jr. |
| 4,449,964 | A | * | 5/1984 | Westberg et al. |
| 5,045,047 | A | * | 9/1991 | Hutchins et al. |
| 5,409,443 | A | | 4/1995 | Zabriskie et al. |
| 6,387,030 | B1 | | 5/2002 | Moore et al. |

FOREIGN PATENT DOCUMENTS

| | | | |
|---|---|---|---|
| DE | 3334655 A1 | | 4/1985 |
| DE | 3512848 A1 | * | 10/1985 |
| DE | 3805894 C1 | | 3/1989 |
| GB | 1490165 A | | 10/1977 |
| GB | 2388562 A | * | 11/2004 |
| JP | 58-84063 | * | 5/1983 |
| JP | 61-139756 | * | 6/1986 |
| JP | 63-142261 | * | 6/1988 |
| JP | 5-301060 | * | 11/1993 |
| JP | 2003-334468 | * | 11/2004 |

OTHER PUBLICATIONS

Japanese Abstract No. 58084063, dated May 20, 1983.
WPI Abstract Accession No. 1988–203087 & Japanese Abstract No. 63142261, dated Jun. 14, 1988.

* cited by examiner

*Primary Examiner*—Charles E. Cooley
(74) *Attorney, Agent, or Firm*—Sughrue Mion, PLLC

(57) ABSTRACT

A bio cell cleaning centrifuge having a detachable inner chamber body. The centrifuge includes a rotor detachable from a drive mechanism. Test tube holders are pivotally movably supported on the rotor for holding test tubes. A cleaning liquid distributor is detachably disposed on the rotor for supplying cleaning liquid to the respective test tubes. A bowl detachable from the drive mechanism is disposed below the test tube holders. The inner chamber body is disposed below the bowl for receiving therein supernatant liquid discharged out of the test tubes during rotation of the rotor. The inner chamber body is detachably mounted on a main case. The inner chamber body is detached after the distributor, the rotor, and the bowl are detached.

9 Claims, 5 Drawing Sheets

BIO CELL CLEANING CENTRIFUGE HAVING DETACHABLE CHAMBER BODY

BACKGROUND OF THE INVENTION

The present invention relates to a centrifuge having cleaning arrangement for centrifugally cleaning bio cell such as red blood cell with cleaning liquid.

A bio cell cleaning centrifuge is installed in a clinical laboratory at a hospital and a blood bank for automatically performing bio cell cleaning operation in a blood transfusion check up. As shown in FIGS. 7 and 8 in a conventional bio cell cleaning centrifuge, a drive shaft 105 extends vertically from a drive motor (not shown), and a rotor 106 is coaxially held on the drive shaft 105. The rotor 106 has an outer peripheral portion provided with a plurality of test tube holder 121 each for detachably holding each test tube 7 in which hema H is accumulated. Each test tube holder 121 is pivotally movably supported to the rotor 106 so that the test tubes 7 can be oriented toward a horizontal direction as shown in FIG. 7 because of the centrifugal force upon rotation of the rotor 106.

A decant magnet 111 is stationarily provided coaxially with the drive shaft 105 for temporarily attracting the test tube holder 121 upon application of electric current to the decant magnet 111, so that approximately vertical orientation of the test tubes 7 can be maintained as shown in FIG. 8.

A bowl 112 is provided coaxially with the decant magnet 111. The bowl 112 has a rise-up end portion to which each free end of the test tube holder 121 is abuttable when the test tube holder 121 is pivotally moved toward the horizontal direction.

Above the rotor 106, a distributor 130 is provided for distributing a cleaning liquid such as a physiological saline into the respective test tubes 7. The distributor 130 is rotatable together with the rotation of the rotor 106. A nozzle 110 is open to the distributor 130 and is fluidly connected to a cleaning liquid source through a tube 109.

In operation, the rotation of the motor is started to enter acceleration mode M1 as shown in FIG. 9. Incidentally, a horizontal axis represents a single operation cycle and a vertical axis represents a rotation number in FIG. 9. Upon actuation of the motor, the test tube holders 121 are pivotally moved toward the horizontal direction until each free end abuts the rise-up end of the bowl 112. In this case, each test tube 7 is inclined at an angle of, for example, 38 degrees from an axis of rotation of the rotor 106.

During the acceleration mode M1, physiological saline is injected into the distributor 130 through the nozzle 110, so that the physiological saline is evenly distributed into respective test tubes 7 at a timing and period indicated by a block portion T1. In this instance, hema H is agitated with the physiological saline thereby being cleaned.

Then, the motor is entered into a constant speed mode M2 for centrifugation. For example, the motor is rotated at 3000 r.p.m. for 35 seconds. In the centrifugation, hema H is deposited on a bottom of each test tube 7, whereas blood serum and other unwanted materials remain on a supernatant fluid.

At a terminal phase of the constant speed mode M2 and immediately before a deceleration mode M3, physiological saline is again distributed into each test tube 7 at a timing and period indicated by a block portion T2 in order to enhance cleaning to the bio cell. Incidentally, the distribution timing can be adjusted by an adjustable switch (not shown).

After deceleration mode M3, rotation of the motor is temporarily stopped, and electrical current is supplied to the decant magnet 111 for magnetically absorbing each test tube holder 121 thereto. As a result, each test tube 7 is directed to approximately vertical direction or −8 degrees with respect to the axis of rotation of the rotor 106.

While maintaining this magnetically attraction state, the motor is again energized and rotated at relatively low speed such as 400 r.p.m in a low speed mode M4. In this case, supernatant fluid S rises up along each wall of the test tube 43 and are discharged outwardly from each upper open end of each test tube 7. Thus, precipitated hema H only remains in the test tube 7. The cycle including acceleration mode M1, constant speed mode M2, deceleration mode M3 and the low speed mode M4 is repeated three times.

The cleaning liquid and supernatant fluid discharged from the test tubes 7 is collected onto a chamber body 118 shown in FIG. 10 provided integrally with the main casing and positioned below the bowl 112. Then, the fluid is discharged out of a main casing (not shown) of the centrifuge through a discharge opening 118*a* formed at a bottom of and an outer peripheral portion of the chamber body 118.

However, the overflowed liquid in the chamber body 118 is directed toward a center of the main casing because of air flow in the chamber body 118 during centrifugation as indicated by arrows in FIG. 10. That is, because of the rotation of the rotor 106, air in the chamber body 118 is urged radially outwardly. However, the air reaching the wall of the chamber body 118 is flowed along the wall of the chamber body 118 and is then directed toward the center portion of the main casing. Therefore, liquid adhered onto the wall of the chamber body 118 is directed toward the center portion, which degrade the discharging efficiency of the liquid.

Accordingly, entire liquid in the chamber body 118 cannot be discharged outside through the discharge opening 118*a*, but a part of the liquid may remain in the chamber body 118. Due to the remaining liquid, propergation of various germs may occur in the chamber body, and the germs may adhere to the chamber body wall to degrade flowablity of the liquid. This further promotes growth of the various germs.

If next centrifugation is performed with new bio cell while the previous liquid remains in the chamber body 118, the remaining liquid may be converted into mist during centrifugation which may be entered into interior of the drive motor and main casing. As a result, rust and corrosion may occur to reduce service life of the centrifuge. Moreover, the growth of the various germs generates stink, or may be mixed with the cleaned bio cell samples to degrade reliability of the test.

In order to avoid the above-described drawbacks, the chamber body 118 itself must be cleaned. However, the chamber body 118 is normally provided integrally with the main case in order to maintain high rigidity and high strength for the purpose of preventing broken pieces from being scattered outwardly of the main case if the rotary member such as the rotor 106 is broken, and preventing any fluid and mist in the chamber body 118 from being entered into the driving portion such as bearing portion of the drive motor. Therefore, cleaning to the chamber body 118 itself cannot be easily performed. Further, if cleaning is performed to the chamber body while the main case is fixed at its stationary position, cleaning water may be entered into the drive motor to damage to the same. If broken pieces of the test tube remains in the chamber body, operator's finger may be injured and the operator may suffer from contagion.

SUMMARY OF THE INVENTION

It is an object of the present invention to overcome the above-described problems and to provide a bio cell cleaning centrifuge improving discharging efficiency of cleaning liquid and facilitating maintenance to the chamber body.

This and other objects of the present invention will be attained by a bio cell cleaning centrifuge for cleaning bio cell with a cleaning liquid, the centrifuge including a main case, a drive mechanism, a rotor, a plurality of test tube holders, a cleaning liquid distributor, a cleaning liquid supplying mechanism, a posture maintaining unit, an inner chamber body, and an outer chamber body. The drive mechanism is supported in the main case and defines a rotation axis. The rotor is detachably coupled to the drive mechanism and is rotationally driven about the rotation axis by the drive mechanism. The plurality of test tube holders are pivotally movably supported to the rotor. The test tubes held by the test tube holders are pivotally movable toward a horizontal direction upon application of centrifugal force thereto. The cleaning liquid distributor is disposed above the rotor and is rotatable together with the rotor for evenly distributing the cleaning liquid to the respective test tubes held by the test tube holders. The cleaning liquid distributor is detachable from the rotor. The cleaning liquid supplying mechanism is provided to the main case for supplying the cleaning liquid to the cleaning liquid distributor. The posture maintaining unit is disposed adjacent to the drive mechanism for maintaining a predetermined orientation of the test tube holders for a discharge of a supernatant liquid from the test tubes during rotation of the rotor. The inner chamber body is disposed below the test tube holders for temporarily receiving the supernatant liquid discharged out of the test tubes. The inner chamber body is detachable from the main case. The outer chamber body is disposed below the inner chamber body and surrounds the inner chamber body.

DETAILED DESCRIPTION OF THE PREFERRED EMBODIMENTS

A bio cell cleaning centrifuge according to a first embodiment of the present invention will be described with reference to FIGS. 1 through 5.

Figure 1:
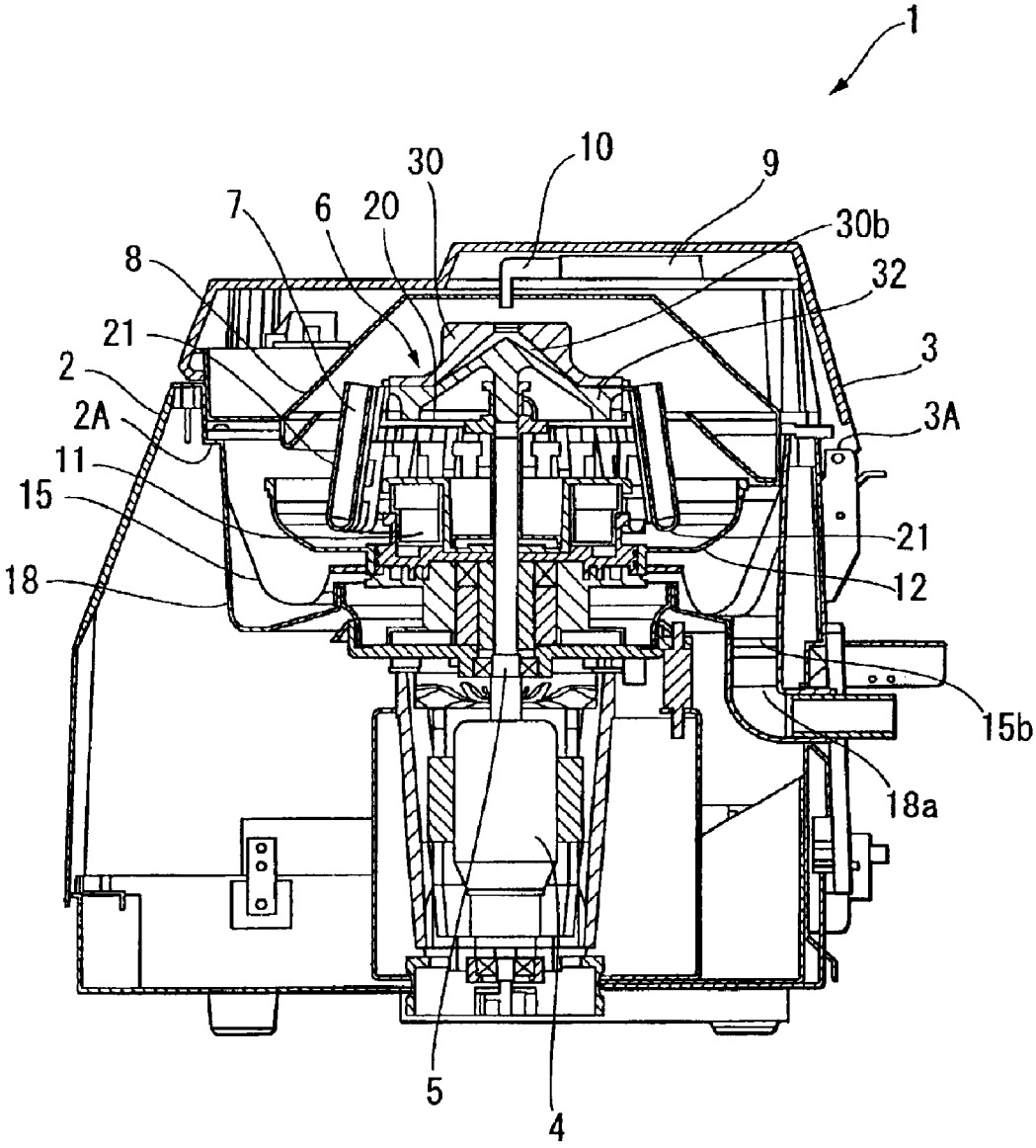
FIG. 1 is a cross-sectional view showing an entire construction of a bio cell cleaning centrifuge according to a first embodiment of the present invention.
Figure 2:
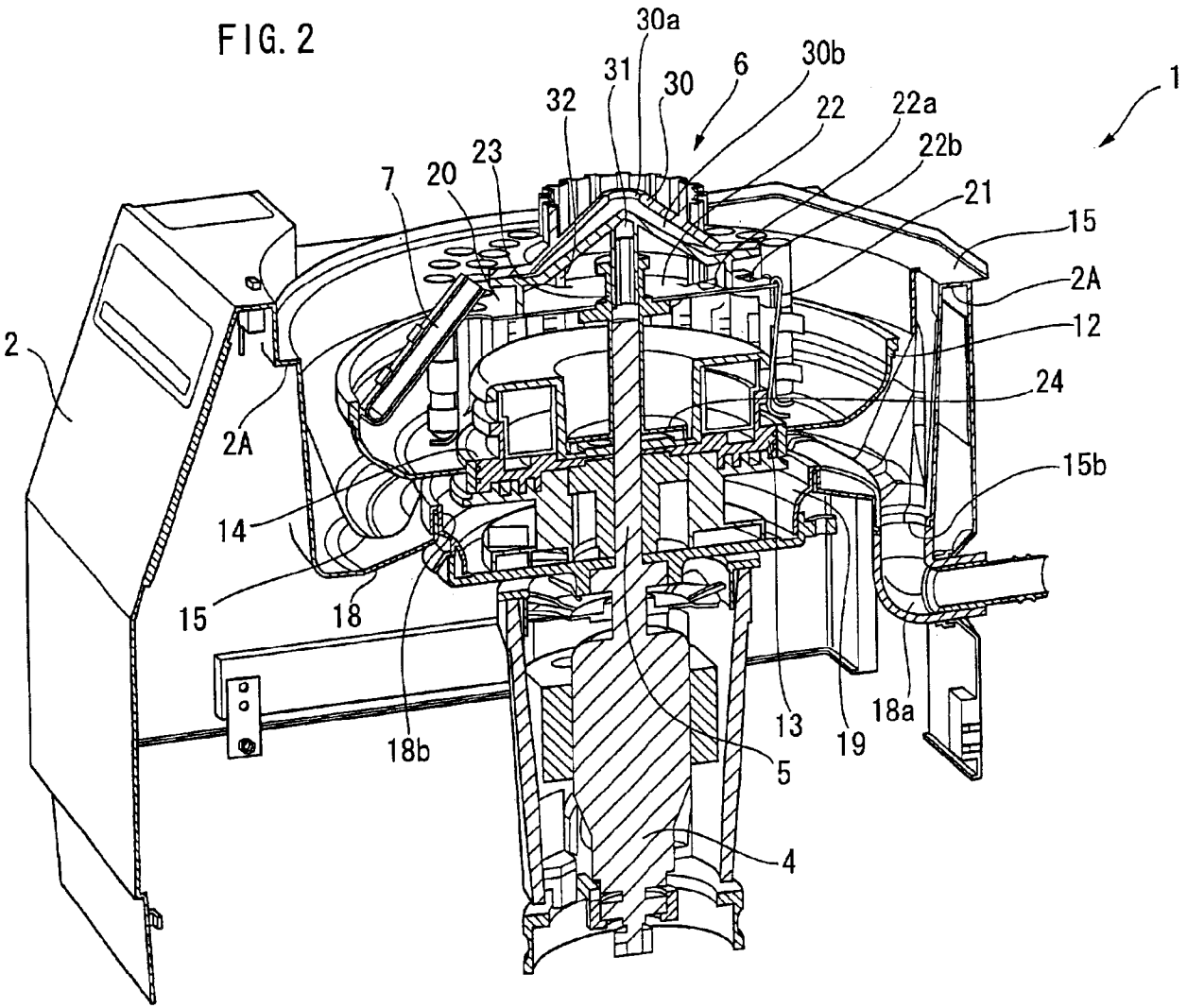
FIG. 2 is a partial perspective view showing positional relationship among a cleaning liquid distributor, a rotor, a bowl, an inner chamber body, an outer chamber body and a main case according to the first embodiment.
Figure 3:
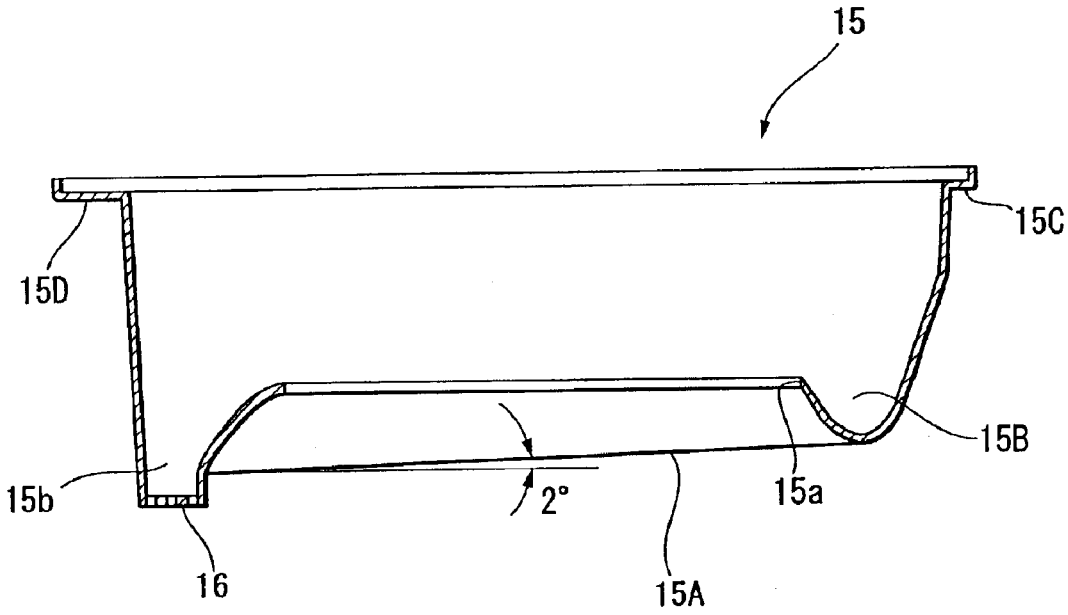
FIG. 3 is a vertical cross-sectional view showing the inner chamber body according to the first embodiment.

As shown in FIG. 1, a bio cell cleaning centrifuge 1 includes a main case or a cabinet 2 and an upper lid 3 for covering an opening (open end) of the main case 2. The main case 2 has a horizontal upper wall section 2A in which the opening is defined. The upper lid 3 is pivotally supported to the main case 2 at a pivot shaft 3A.

In the main case 2, a drive mechanism including a drive motor 4 having a drive shaft 5 is installed. The drive motor 4 is driven upon application of a drive voltage by way of a drive circuit (not shown). A bio cell cleaning rotor 6 is detachably attached to the drive shaft 5 and is positioned near the upper open end of the main case 2, so that the bio cell cleaning rotor 6 is rotatable together with the rotation of the drive shaft 5.

The bio cell cleaning rotor 6 includes a main rotor 20 and a cleaning liquid distributor 30 coaxially and detachably disposed above the main rotor 20. The main rotor 20 is provided with a plurality of test tube holders 21 each for holding each test tube 7 in which a suitable amount of bio cell such as red blood cell is accumulatable. The plurality of test tube holders 21 is a magnetically attracted member made from SUS430. The test tube holders 21 permit the test tubes 7 to be oriented toward a horizontal direction in accordance with a centrifugal force upon rotation of the main rotor 20.

The main rotor 20 has a disc portion 22 and a central sleeve 23 detachably engageable with the drive shaft 5. The disc portion 22 is formed with a radially extending slots 22*a* positioned at a constant angular interval. Further, at an outer circumferential end portion of the disc portion 22, a plurality of rectangular holes 22*b* are provided. Each test tube holder 21 is pivotally supported to each rectangular hole 22*b*, so that each test tube holder 21 can be pivotally moved about each rectangular hole 22*b*. The main rotor 20 also has a flange portion 24 at which engagement pins (not shown) are provided for engaging pins (not shown) protruding from the drive shaft 5. Engagement between pins will transmit rotation of the drive shaft 5 to the rotor body 20.

A pump (not shown) is provided at an outside of and a side wall of the main case 2. The pump is connected to a cleaning liquid tank (not shown). A hose 9 is connected to the pump for directing the cleaning liquid toward the cleaning liquid distributor 30. At the lid 3, a nozzle 10 is provided which is connected to the hose 9. The nozzle 10 is directed at a rotational center portion of the cleaning liquid distributor 30. The cleaning liquid distributor 30 is rotatable together with the rotation of the main rotor 20, and is adapted for distributing cleaning liquid supplied from the nozzle 10 equally into each test tube 7 held by the test tube holders 21 for cleaning bio cell in each test tube 7 during rotation of the main rotor 20.

The cleaning liquid distributor 30 is positioned above the main rotor 20 in concentrical fashion therewith. The cleaning liquid distributor 30 is detachably connected to the main rotor 20 by the engagement of protrusions 32 with the radial slots 22*a*. Further, a central sleeve 31 extends downwardly to detachably engage the sleeve 23 of main rotor 20.

Therefore, the rotation of the main rotor 20 is transmitted to the distributor 30. The distributor 30 is formed with a central opening 30*a* through which the cleaning liquid is supplied from the nozzle 10. The distributor 30 is formed with a plurality of radially extending liquid passages 30*b* for supplying cleaning liquid into respective test tubes 7.

The main rotor 20 includes a test piece holder attraction member 11 (decant magnet) made from an electrically magnetic body. The test piece holder attraction member 11 is adapted for selectively attracting the test piece holder 21 in order to maintain approximately vertical orientation of the test piece 7 during rotation of the bio cell cleaning rotor 6 at a low speed for centrifugally discharging supernatant liquid radially outwardly from the test tube 7.

A drain cover 8 is provided for covering the upper area of the rotor 6. Further, a bowl 12 is provided immediately below the test tube holder 21 for regulating the inclination angle of the test tubes 7 during rotation of the rotor 6. That is, each bottom of the test tube 7 is abuttable against a vertical wall of the bowl 12 to define the maximum inclination angle of the test tubes 7. The bowl 12 is provided detachable from a bracket 13 fixed to the drive shaft 5. A packing 14 is provided at an outer peripheral surface of the bracket 13 to provide hermetic arrangement at a boundary between the bracket 13 and the bowl 12.

An inner chamber body 15 is provided below the bowl 12 for temporarily accumulating therein the supernatant liquid discharged out of the test tubes 7. The inner chamber body 15 has a bottom wall section 15A defining a liquid accumulating section 15B and formed with a center hole 15*a* through which the part of the drive mechanism extends. A drain hole 15*b* is formed at a radially outer end portion of the liquid accumulating section 15B. The bottom wall section 15A is inclined at an angle of 2 degrees from a horizontal plane, so that the drain hole 15*b* is positioned at the lowest position. A porous filter 16 is provided at the drain hole 15*b* for preventing a broken glass pieces of test tubes from being discharged through the drain hole 15*b*.

Figure 4:
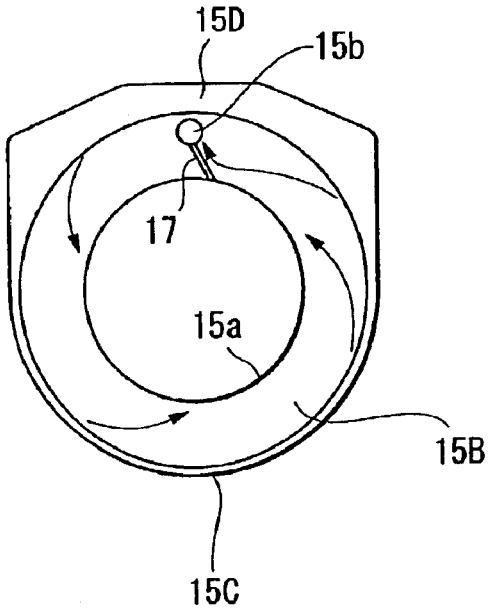
FIG. 4 is a plan view showing the inner chamber body of FIG. 3.

A rib 17 protrudes upwardly from the bottom wall section 15A and extends toward the drain hole 15*b* in a diagonal direction shown by the arrows in FIG. 4. That is, an upstream end of the rib 17 is positioned upstream of the drain hole 15*b* in the rotational direction of the rotor body 20. The rib 17 has a downstream end positioned at a downstream side of the drain hole 15*b*. The rib 17 can prevent the supernatant liquid to flow radially inwardly but permits the liquid to flow toward and into the drain hole 15*b*.

The inner chamber body 15 is also provided with an upper flat sections 15C and 15D those being mountable on the upper horizontal wall section 2A of the main case 2. Thus, the inner chamber body 15 can be easily set on the main case 2 by suspending the inner chamber body 15 from the upper horizontal wall section 15C and 15D, and can be easily detached from the upper horizontal wall section 2A.

An outer chamber body 18 is provided immediately below the inner chamber body 15 and is formed with a drain hole 18*a* in alignment with the drain hole 15*b* of the inner chamber body 15. The outer chamber body 18 is formed with a center opening 18*b* detachably engaged with a cover member 19 provided around the drive shaft 5. The outer chamber body 18 is provided integrally with the upper horizontal wall 2A of the main case 2.

In operation, the test tubes 7 are held by the test tube holders 21 in nearly a vertical posture. In each test tube 7, a desired amount of bio cells such as red blood cells are accumulated. By rotating the drive motor 4, the test tubes 7 are gradually oriented toward the horizontal direction. In this instance, when the pump is actuated to introduce the cleaning liquid toward the nozzle 10, the cleaning liquid is ejected out of the nozzle 10 into cleaning liquid distributor 30 through the cleaning liquid inlet hole 30*a*. The cleaning liquid passes through the liquid passages 30*b* and evenly distributed into respective test tubes 7. After a predetermined amount of the cleaning liquid is accumulated in the test tube 7, the pump is stopped to terminate a process of injection of the cleaning liquid.

Figure 8:
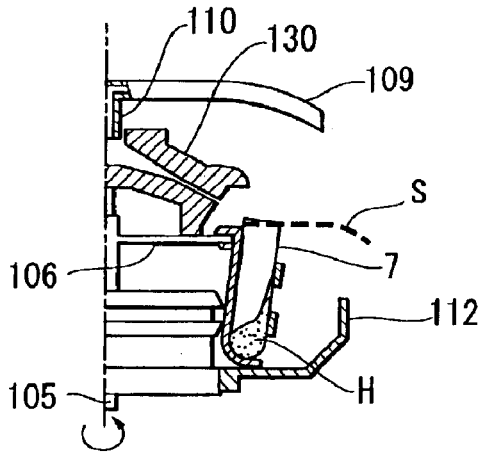
FIG. 8 PRIOR ART
FIG. 8 is an explanatory diagram showing a state where liquid are discharged out of the test tube in the conventional centrifuge.
Figure 9:
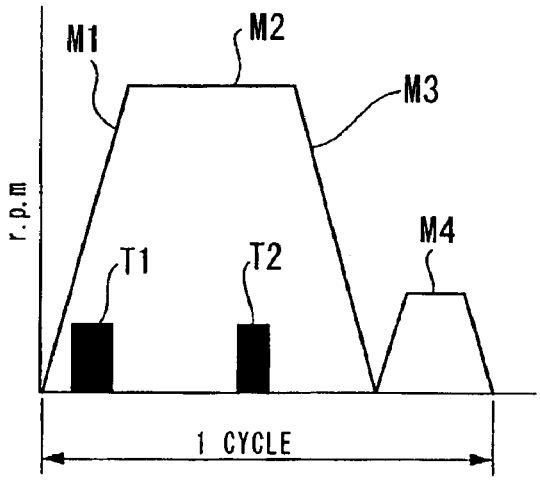
FIG. 9 PRIOR ART
FIG. 9 is a graphical representation showing variation in rotation speed of the rotor per a single cleaning cycle in the conventional device.
Figure 10:
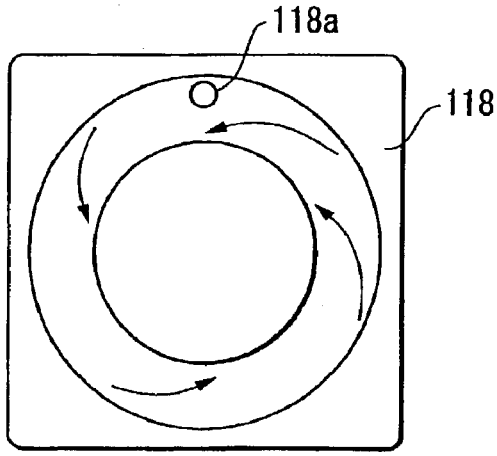
FIG. 10 PRIOR ART
FIG. 10 is a schematic plan view showing a chamber body of the conventional centrifuge.

Subsequently, rotation of the rotor 6 is continued until the floating bio cells are congregated onto the bottom of the test tube 7. Then, the rotation of the rotor 6 is stopped to restore the test tube holder 21 into their vertical orientation. In this case, because of the magnetically attractive force of the test tube holder attraction member 11, the test piece holders 21 are attracted to the test tube holder attraction member 11. In this state, the test tube 7 is directed substantially in a vertical direction, or the test tube 7 is directed such that its open end is slightly inclined radially outwardly as shown by FIG. 8.

Then, the drive motor 4 is rotated at a low speed while maintaining the electrically magnetic force of the attraction member 11, so that the test tubes 7 are moved along a circular locus while maintaining their substantially vertical orientations. Accordingly, the supernatant liquid accumulated in each test tube 7 is discharged out of the test tube 7 because of the application of centrifugal force, while the bio cells deposited on the bottom of the test tube 7 remains in the test tube 7. Such cleaning process is repeatedly performed in order to remove foreign materials such as antibodies from the bio cells.

During the cleaning process, the supernatant liquid flying into the inner chamber body 15 and is accumulated in the accumulating section 15B, and then discharged toward the outer chamber body 18 through the drain hole 15*b*. In this case, because the rib 17 is provided in the bottom wall section 15A, and the drain hole 15*b* is at the lowest vertical level in the inner chamber body 15, the discharge of the liquid through the drain hole 15*b* can be promoted. In this case, an upper open space can be provided at an upper side of the outer chamber body 18. Therefore, the outer chamber body 18 can also be cleaned easily if desired.

If cleaning to the inner chamber body 15 is required, the distributor 30 is detached from the main rotor 20. Then, the main rotor 20 is detached from the drive shaft 5. Then, the bowl 12 is detached from the bracket 13. Thus, an open space is provided at an upper space of the inner chamber body 15. Then, the operator holds the horizontal wall section 15C and 15D and moves upwardly the inner chamber body 15 away from the upper horizontal wall section 2A of the main case 2. Consequently, the inner chamber body 15 can be solely cleaned.

Figure 5:
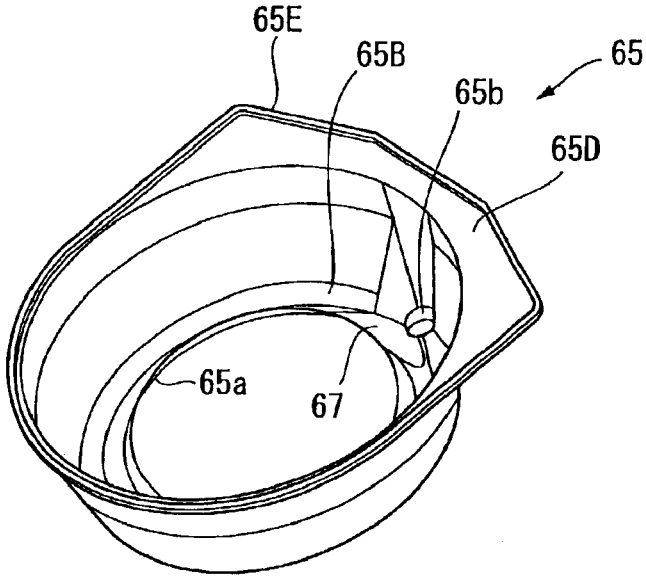
FIG. 5 is a perspective view showing an inner chamber body according to a second embodiment of the present invention.
Figure 6:
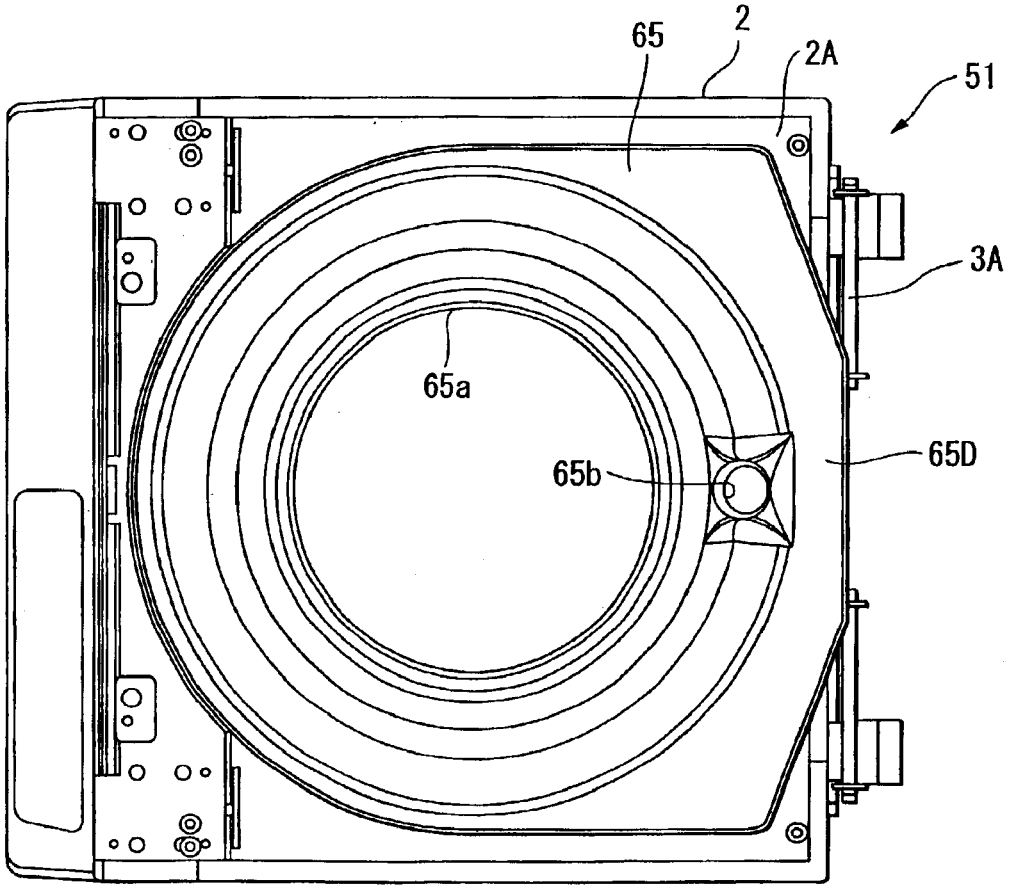
FIG. 6 is a plan view showing the positional relationship between the inner chamber body and a main case according to the second embodiment while omitting an upper lid.
Figure 7:
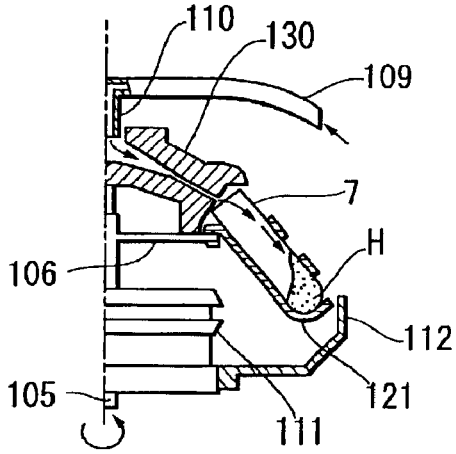
FIG. 7 PRIOR ART
FIG. 7 is an explanatory diagram showing a state where test tubes are oriented toward a horizontal direction in accordance with the rotation of the rotor in a conventional centrifuge.

A bio cell cleaning centrifuge 51 according to a second embodiment of the present invention will be described with reference to FIGS. 5 and 6. In the second embodiment, an inner chamber body 65 has an upwardly bulged part 67 instead of the rib 17 of the first embodiment at a bottom wall section 65 for positively directing the liquid in a liquid accumulating section 65B toward a drain hole 65*b*. Further, a flat enlarged section 65D is provided at the upper part of the inner chamber body 65. Further, a vertically rib 65E protrudes from an entire outer contour of the flat enlarged section 65D so as to temporarily maintain liquid on the flat enlarged section 65D.

The flat enlarged section 65D is mounted on the upper horizontal wall section 2A of the main case 2. The flat enlarged section has an external contour greater than an external contour of the main case 2 at a side of the pivot portion 3A. That is, the flat enlarged section 65D protrudes out of the main case 2 at the side of the pivot portion 3A. This enlarged section 65D can prevent the liquid adhered onto the drain cover 8 from dripping onto an external surface of the main case 2 and onto ambient area when the upper lid 3 is opened. The liquid dripped onto the enlarged section 65D can be maintained thereon because of the provision of the vertical rib 65E. Incidentally, the reference numeral 65*a* designates a center hole corresponding to the center hole 15*a* of the first embodiment.

While the invention has been described in detail with reference to specific embodiments thereof, it would be apparent to those skilled in the art that various changes and modifications may be made therein without departing from the spirit and scope of the invention. For example, in the first embodiment, a groove can be formed instead of the rib 17 for directing the liquid toward the drain hole 15*b*.

What is claimed is:

1. A bio cell cleaning centrifuge for cleaning bio cell with a cleaning liquid, the centrifuge comprising:

a main case;

a drive mechanism supported in the main case and defining a rotation axis;

a rotor detachably coupled to the drive mechanism and rotationally driven about the rotation axis by the drive mechanism;

a plurality of test tube holders pivotally movably supported to the rotor, the test tubes held by the test tube holders being pivotally movable toward a horizontal direction upon application of centrifugal force thereto;

a cleaning liquid distributor disposed above the rotor and rotatable together with the rotor for evenly distributing the cleaning liquid to the respective test tubes held by the test tube holders, the cleaning liquid distributor being detachable from the rotor;

a cleaning liquid supplying mechanism provided to the main case for supplying the cleaning liquid to the cleaning liquid distributor;

a posture maintaining unit disposed adjacent to the drive mechanism for maintaining a predetermined orientation of the test tube holders for a discharge of a supernatant liquid from the test tubes during rotation of the rotor;

an inner chamber body disposed below the test tube holders for temporarily receiving the supernatant liquid discharged out of the test tubes, the inner chamber body being detachable from the main case; and an outer chamber body disposed below the inner chamber body and surrounding the inner chamber body.

2. The bio cell cleaning centrifuge as claimed in claim 1, wherein the main case has an upper horizontal wall section, and wherein the inner chamber body is formed with a central hole through which a part of the drive mechanism extends, and wherein the inner chamber body has an upper flat wall section detachably mounted on the upper horizontal wall section of the main case.

3. The bio cell cleaning centrifuge as claimed in claim 1, wherein the inner chamber body has a bottom wall section at which a drain hole is formed for discharging the supernatant fluid therethrough, the bottom wall being inclined so that the drain hole is positioned at the lowest position in the inner chamber body.

4. The bio cell cleaning centrifuge as claimed in claim 3, further comprising a filter disposed at the drain hole.

5. The bio cell cleaning centrifuge as claimed in claim 1, wherein the inner chamber body has a bottom wall section defining a supernatant liquid accumulation space, and wherein the bottom wall section is provided with a rib extending toward the drain hole, the rib having an upstream end positioned upstream of the drain hole in a rotational direction of the rotor, and a downstream end positioned at a downstream end of the drain hole.

6. The bio cell cleaning centrifuge as claimed in claim 1, wherein the inner chamber body has a bottom wall section defining a supernatant liquid accumulation space, and wherein the bottom wall section is formed with a groove extending toward the drain hole, the groove having an upstream end positioned upstream of the drain hole in a rotational direction of the rotor, and a downstream end positioned at a downstream end of the drain hole.

7. The bio cell cleaning centrifuge as claimed in claim 1, wherein the inner chamber body has a bottom wall section defining a supernatant liquid accumulation space, and wherein the bottom wall section has an upwardly bulged region positioned adjacent to the drain hole.

8. The bio cell cleaning centrifuge as claimed in claim 1, wherein the inner chamber body has an upper flat wall section having a horizontally extending section; and wherein the centrifuge further comprises an upper lid pivotally movably supported at a pivot portion on one side of the main case for covering an open end of the main case, the horizontally extending section protruding out of the one side of the main case and covering the pivot portion.

9. The bio cell cleaning centrifuge as claimed in claim 8, wherein the upper flat wall section has an outer contour, and the upper flat wall section comprises a continuous rib protruding upwardly from the outer contour.

* * * * *